United States Patent [19]

Joyer

[11] Patent Number: 5,010,625

[45] Date of Patent: Apr. 30, 1991

[54] SCREW-ON BUTTON

[76] Inventor: Richard A. Joyer, P.O. Box 778, Pearsall, Tex. 78061

[21] Appl. No.: 360,472

[22] Filed: Jun. 2, 1989

[51] Int. Cl.[5] ..... A44B 1/18

[52] U.S. Cl. ..... 24/90 R; 24/90 C; 24/105

[58] Field of Search ..... 24/90 R, 90 C, 90 TA, 24/104, 105

[56] References Cited

U.S. PATENT DOCUMENTS

| | | | |
|---|---|---|---|
| 328,721 | 10/1885 | Scott | 24/90 R |
| 375,373 | 12/1887 | May | 24/105 |
| 721,203 | 2/1903 | Landman | 24/90 R |
| 1,026,017 | 5/1912 | Anderson | 24/90 R |
| 1,594,416 | 8/1926 | Kellog | 24/105 |
| 1,619,706 | 3/1927 | Coates | 24/105 |
| 2,118,561 | 5/1938 | Kleeberg | 24/90 R |
| 2,814,047 | 11/1957 | Lev | 24/105 |
| 3,005,204 | 10/1961 | Silver | 24/105 |
| 3,226,790 | 1/1966 | Brown | 24/453 |
| 3,967,348 | 7/1976 | Rogen | 24/90 C |
| 4,662,034 | 5/1987 | Cunningham | 24/90 R |

*Primary Examiner*—Victor N. Sakran
*Attorney, Agent, or Firm*—Cox & Smith

[57] ABSTRACT

A button assembly is disclosed which includes a spear that is removably connected to the back side of a button head for enabling penetration of a post (or shank) of the button head through a piece of fabric. The post, itself, is threaded so that a locking disc can be screwed onto the post on the back side of the fabric once the spear has been removed and discarded therefrom. The surfaces of the disc and the button head which engage the fabric are also provided with teeth so that the button is not loosened from the fabric once it has been fastened thereto.

3 Claims, 1 Drawing Sheet

SCREW-ON BUTTON

BACKGROUND OF THE INVENTION

1. Field of Use:

The present invention relates to fasteners for attaching or enabling attachment of buttons to fabric materials. More specifically, the invention relates to an article or an assembly having removable means for enabling penetration of a button shank or other member through a fabric to enable attachment of the button.

2. Background Art:

Buttons are believed to have been initially developed as a convenient means for connecting two pieces of fabric together. As buttons have developed, they have been employed throughout all areas of the textile industry. In fact, today, buttons are so common that they are often employed simply for decorative purposes. However, for almost as long as buttons have been known, they have been snapped, popped, lost and broken from the fabric on which they were connected.

Typically, buttons comprise a disc-like member with one or more holes therethrough for "permanently" stitching the button to a piece of fabric by means of needle and thread. Although the thread stitching a button to fabric is typically doubled over time and again to reinforce the stitch, breaking of that thread and subsequent removal of the button from the fabric is commonplace, especially when the thread is subject to excessive stress or as the thread becomes weakened through extended use.

The most obvious way to remedy the removal of a button is to sew it back onto the fabric. That process, though, can be a real nuisance due to the time, patience and skill required. Many would rather go without the button than put themselves through the tedious task of replacing it. Furthermore, once a button is replaced, it is still just as susceptible to being popped from the fabric again. Those consequences may be especially acute when an individual is inexperienced or inept with a needle and thread.

For centuries, medals, ribbons, brooches and a variety of other ornamental articles have been fastened to fabric by means of sharpened pins that are connected to the back of the article and are used to pierce the fabric. Typically, once the pin has pierced the fabric, it is secured at its tip by some form of locking means to complete the attachment. That form of fastener is advantageous since it can be performed quickly and easily. On the other hand, the sharpened pin of such fasteners almost necessarily risk injury, although minor, to an individual who later wears or otherwise comes in contact with the fabric.

Consequently, it is an object of this invention and many others to enable fastening of an article to a piece of fabric through the use of a sharpened member in a manner such that injury is avoided.

It is another object of the present invention to enable fastening of a button to fabric by means of a sharpened member in a manner which minimizes discomfort when the fabric is worn.

Another object of the present invention is to provide a fastening means for permanently fastening a button to a piece of fabric.

Still other objects include producing a simple, easily-manufactured, and low-cost button having means formed integrally therewith for attaching the button to a piece of fabric. Many other objects will be obvious to those of ordinary skill in the art in light of the prior art, the following descriptions, the attached drawings and the appended claims.

SUMMARY OF THE INVENTION

The present invention approaches the above-mentioned objects and others by providing a button assembly for fastening the head of a button to a piece of fabric on a first side thereof without requiring the use of needle and thread while minimizing the discomfort and risk to an individual wearing the fabric. The button assembly may comprise a head having a post protruding from its back along with a spear (or penetrating shaft) that is removably connected either to the post o to the head for enabling penetration of the post through the fabric from a first side to a second side thereof. Additionally, a disc or other member for mating with the post on the second side of the fabric is provided to secure that post through the fabric, thereby fastening the button head to the fabric on the first side thereof.

The disc for mating with the post may have teeth on its surface which faces the fabric, which teeth are structured and oriented such that the disc is locked in place once it is tightened to engage the fabric between the disc and the head of the button. Similar teeth may also be provided on the base of the head of the button so that the fabric is similarly engaged on its first side by such teeth to further prevent loosening of the button.

Alternatively, a button assembly of the invention may comprise a head, a post and a spear in a configuration such that the post and the spear are punched from the back side of the fabric to enable reception in a socket formed in the head of the button on the first side of the fabric.

Many other features and advantages of the invention will be obvious to one of ordinary skill in the art from the following detailed description of several preferred embodiments, as well as from the attached drawings and the appended claims.

DETAILED DESCRIPTION OF THE PREFERRED EMBODIMENT

Figure 1:
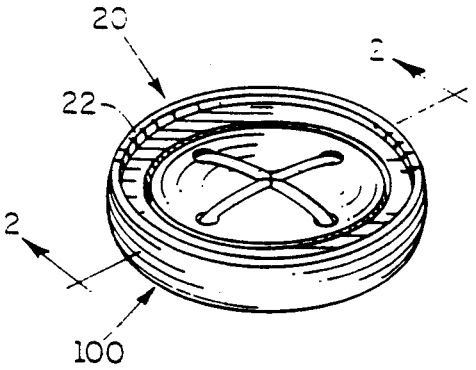
FIG. 1 shows a perspective view of the button head 20 of a first embodiment 100 of the present invention.
Figure 2:
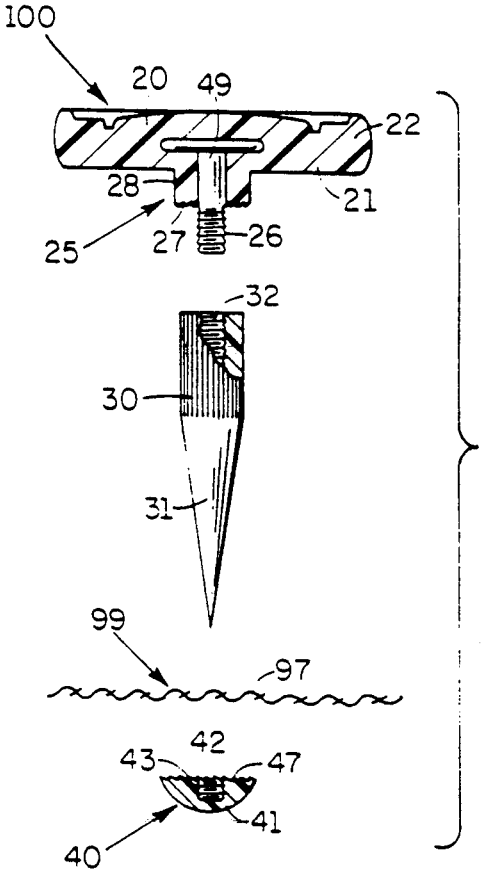
FIG. 2 shows an exploded view of the first embodiment 100 in relation to a piece of fabric 99, the head 20 thereof being shown centrally cross-sectioned and the spear 30 thereof being shown partially cut away.
Figure 5:
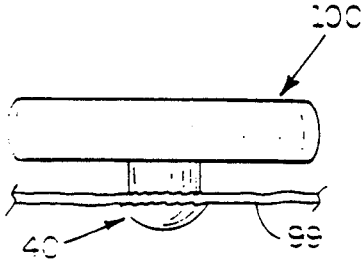
FIG. 5 shows an elevational view of the first embodiment 100 as it is operatively connected to the piece of fabric 99.

Referring to FIG. 1, the present invention teaches means and method for removably fastening a button head 20 to a piece of fabric in a simple and easy manner which does not require the employment of needle and thread. A first embodiment 100 of the invention is shown in FIGS. 1, 2 and 5. The first embodiment 100 comprises three basic members—head 20, spear 30 and locking disc 40.

Throughout this description, terms such as "lower" and "upper" are used to describe the first embodiment 100, a second embodiment 200 and a third embodiment 300 of the present invention. However, such terms are merely used for the purposes of this description to relate and distinguish certain members and their orientation from others. Obviously, although the drawings show "lower" features beneath "upper" features, they could just as easily be oriented to one side or above the "upper" features, and vice versa. Accordingly, it should be understood that such words are not limitations in any respect.

Referring to FIG. 1, head 20 of the first embodiment 100 is decoratively embossed to give the appearance of a sew-through (or "Mannish") button. However, head 20 could obviously be modified to give the appearance of other types of buttons or articles as would be obvious to one of ordinary skill in the art.

Referring to FIG. 2, head 20 has a shank 25 protruding from the center of the back 21 thereof. Shank 25, itself, comprises a base 28 and a post 26. Post 26 is concentric with base 28, but post 26 protrudes further from the back 21 of head 20. Base 28 is a cylindrical protrusion of substantially smaller diameter than the rim 22 of head 20, and base 28 is provided with radially oriented saw-toothed teeth 27 formed on its lower surface. Base 28 is formed integrally with head 20. Post 26 is a threaded member which is actually the distal end of the shank of a screw 49 encased by a break-resistant plastic material during the formation of head 20. The threads of post 26 are provided for threadably engaging either the spear or the locking disc 40, as appropriate to enable operation of the invention.

The spear 30 is a shaft having a point 31 at its lower end for piercing through fabric 99. The upper end of spear 30 has a threaded socket 32 bored coaxially into the center thereof for connecting spear 30 to the post 26 of head 20. The conical surface of point 31 is preferably fluted (or scored lengthwise) to enhance the grip-ability of point 31 for purposes of unscrewing spear 30 from attachment with head 20 once spear 30 has served its purpose of enabling Penetration of post 26 through a fabric 99. Although not particularly evident from the drawings, spear 30 has a diameter which is appreciably smaller than the diameter of base 28.

The locking disc 40 has a rounded lower surface 41 and a threaded socket 42 oriented coaxially into its upper surface 43. The threads of socket 42 are provided for threadably engaging post 26 once post 26 has penetrated through fabric 99, thus securing head 20 to that fabric 99. The upper surface 43 of locking disc 40 is also provided with radially oriented saw-toothed teeth 47 for enabling engagement with fabric 99. The teeth 47 are similar in function and profile to the teeth of a ratchet in that teeth 27 enable rotation in one direction but oppose rotation in the opposite direction. More specifically, teeth 47 are such that locking disc 40 can be easily tightened onto post 26, but locking disc 40 is not easily rotated relative to fabric 99 once it has been tightened to engage fabric 99 between surface 43 and the lower surface of base 28. The diameter of locking disc 40 is slightly larger than the diameter of base 28 (as shown in FIG. 5) to enable manual tightening of disc 40. Otherwise, the teeth 27 of base 28 are identical to the teeth 47 of locking disc 40. The teeth 27 of base 28, therefore, also enable tightening of head 20 relative to locking disc 40 but oppose loosening of that connection once the fabric 99 is engaged between locking disc 40 and the lower surface of base 28.

In order to utilize the first embodiment 100, the post 26 of head 20 is positioned through fabric 99, as enabled by means of spear 30. That basically involves attaching spear 30 to post 26 and then punching spear 30 through fabric 99 from a first side 97 to a second side 98 thereof. Then, spear 30 is threadably removed from post 26 to expose post 26 on the second side 98 of fabric 99 for receiving the socket 42 of locking disc 40. Then, locking disc 40 is screwed onto post 26 to prevent retraction of post 26 from fabric 99. As locking disc 40 is tightened onto post 26, the teeth 27 and 47 of head 20 and locking disc 40, respectively, engage fabric 99 therebetween, creating a self-locking effect which prevents loosening of locking disc 40 relative to head 20. Thus, the first embodiment 100 can be easily attached to fabric 99 by means of a spear which is subsequently removed and discarded in order to prevent injury of individuals using the fabric at a later time. The net result is the permanent fastening of head 20 to fabric 99 in a fashion such as is shown generally in FIG. 5.

Figure 3:
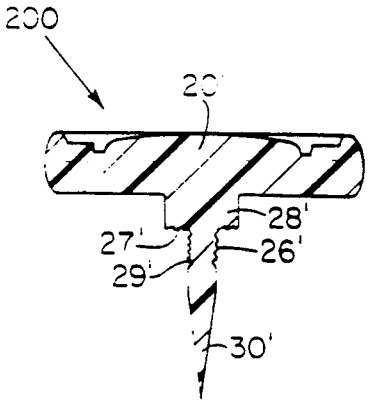
FIG. 3 shows a centrally cross-sectioned view of the head 20' and spear 30' of a second embodiment 200 of the present invention.
Figure 4:
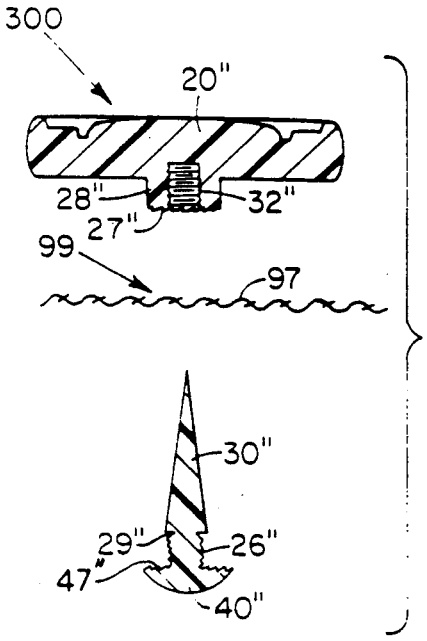
FIG. 4 shows a centrally cross-sectioned view of a third embodiment 300 of the present invention.

A second embodiment and a third embodiment, shown in FIGS. 3 and 4, respectively, each funCtion in a similar manner to permanently affix a button head 20 to a piece of fabric such as fabric 99. Many of the parts of the second embodiment 200 and the third embodiment 300 are similar, if not identical, to parts of the first embodiment 100. Those parts which are substantially similar in structure, function and operation to parts of the first embodiment 100 are numbered with the same arabic numerals, except that a prime (') and a double prime (") are used to designate those parts of the second and third embodiments, respectively. Accordingly, description of the similarly numbered parts of the first embodiment 100 should be considered for a full understanding of the second and third embodiments, as would be obvious to one of ordinary skill in the art Referring to FIG. 3, the second embodiment 200 comprises a head 20', a spear (or penetrating shaft) 30', and a locking disc similar to locking disc 40 of the first embodiment 100. The primary difference between the first embodiment 100 and the second embodiment 200 is that spear 30' is formed integrally with head 20' and post 26' is composed of the same material as head 20' and spear 30' to enable manufacture thereof. Additionally, a circumferential notch 29' is provided around post 26' to enable detachment of spear 30' from post 26'. Such detachment can be accomplished by flexing spear 30' relative to post 26', which tends to break the connection therebetween due to the stress concentration created by circumferential notch 29'.

To utilize the second embodiment 200, the spear 30' and post 26' are punched through a fabric, such as fabric 99, from a first side to a second side thereof and spear 30' is then broken away from post 26., as described above. Then, due to the removal of spear 30', post 26' is exposed on the second side of the fabric for receiving the socket of a locking disc such as locking disc 40 so that retraction of post 26' from the fabric is prevented. Thus, once the locking disc has been tightened onto post 26', the teeth 27' and the teeth of the locking disc engage the fabric therebetween to permanently fasten the button head 20' to the fabric. The spear 30', of course, may be discarded.

Referring to FIG. 4, a third embodiment 300 is shown comprising head 20", spear 30" and locking disc 40". The only difference between the second embodiment 200 and the third embodiment 300 is that spear 30″ and post 26″ are formed integrally with locking disc 40″ rather than with head 20″. In complementary fashion, a threaded socket 32″ is formed on the bottom surface 27″ of base 28″ for receiving and threadably engaging post 26″ when spear 30″ is removed therefrom. Spear 30″ is removed from post 26″ in the same fashion that spear 30′ is removed from post 26′ of the second embodiment 200. The third embodiment 300 is utilized in a substantially similar manner to the second embodiment 200, except that the locking disc 40″ has post 26″ protruding therefrom and is punched through fabric 99 from the second side 98 to the first side 97 and exposed for reception in a socket 32″ of head 20″ to fasten head 20″ to fabric 99 on that first side 97.

Although the invention has been described in conjunction with the foregoing specific embodiments of a screw-on button, many alternatives, variations and modifications will be apparent to those of ordinary skill in the art. Those alternatives, variations and modifications are intended to fall within the spirit and scope of the invention as defined by the following claims.

What is claimed is:

1. An assembly for fastening a button head onto a fabric, comprising:

a head;

a post connected to said head, said post having a first portion and a second portion;

said first portion detachably connected to said second portion with a circumferential notch formed therebetween, said second portion being a means for penetration through said fabric, said circumferential notch being a means for breaking the connection between said first portion and said second portion; and a disc family engageable with said first portion of said post after detachment of said second portion such that said head is rigidly fixed onto said fabric.

2. The assembly of claim 1 wherein said disc has a diameter larger than the diameter of said post.

3. The assembly of claim 8 wherein said first portion of said post has a first set of teeth thereon for locking with the second set of teeth on said disc to engage the fabric therebetween and permanently fasten the button head to the fabric.

* * * * *